33-245 SR
2/26/85 OR 4,501,071

United States Patent [19]

Manske

[11] Patent Number: 4,501,071

[45] Date of Patent: Feb. 26, 1985

[54] MOUNTING SYSTEM FOR OPTICAL SIGHTING DEVICES

[75] Inventor: Heinz J. Manske, Mitchell, Ind.

[73] Assignee: John W. B. Foringer, Bedford, Ind.

[21] Appl. No.: 453,756

[22] Filed: Dec. 27, 1982

[51] Int. Cl.[3] ..... F41G 3/00

[52] U.S. Cl. ..... 33/245; 33/250

[58] Field of Search ..... 33/245, 247, 250, 252

[56] References Cited

U.S. PATENT DOCUMENTS

| | | | |
|---|---|---|---|
| 1,816,195 | 7/1931 | Redfield | 33/245 |
| 2,043,430 | 6/1936 | Doe | 33/245 |
| 2,306,972 | 12/1949 | Meisel | 33/245 |
| 2,368,954 | 2/1945 | Weaver | 33/245 |
| 2,407,977 | 9/1946 | English | 33/250 |
| 2,427,784 | 9/1947 | Herkner | 33/245 |
| 2,545,419 | 3/1951 | Williams | 33/250 |
| 2,567,535 | 9/1951 | Willis et al. | 33/250 |
| 2,743,526 | 5/1956 | Ivy | 33/245 |
| 2,782,508 | 2/1957 | Ivy | 33/245 |
| 3,177,587 | 4/1965 | Hart | 33/245 |
| 3,365,801 | 1/1968 | De Simone, Jr. | 33/245 |
| 3,381,924 | 5/1968 | Gagnier | 248/205 |
| 3,559,940 | 2/1971 | Kruzell | 248/216 |
| 3,579,840 | 5/1971 | Heinzel | 33/245 |
| 3,764,219 | 10/1973 | Collins | 33/245 |
| 3,877,166 | 4/1975 | Ward | 33/245 |
| 4,044,486 | 8/1977 | Van Holten | 33/250 |
| 4,085,511 | 4/1978 | Kovac | 33/250 |
| 4,383,371 | 5/1983 | Coffey | 33/245 |

FOREIGN PATENT DOCUMENTS

| | | | |
|---|---|---|---|
| 274620 | 12/1968 | Austria | 33/245 |
| 2283418 | 3/1976 | France | 33/245 |

*Primary Examiner*—Willis Little

*Attorney, Agent, or Firm*—Leydig, Voit, Osann, Mayer & Holt, Ltd.

[57] ABSTRACT

A mounting system for repeatedly attaching and detaching an optical sighting device having a sighting axis to and from a supporting base having a base axis without interfering with the alignment between the two axes when the sighting device is in place on the base. The system utilizes a plurality of precisely spaced locating points between the holder of the sighting device and the supporting base. It is highly precise, relatively simple in construction, and may be attached and detached without tools. The system finds particular but not exclusive utility for mounting a telescopic sight on a rifle or other firearm.

7 Claims, 7 Drawing Figures

MOUNTING SYSTEM FOR OPTICAL SIGHTING DEVICES

BACKGROUND OF THE INVENTION

The present invention relates to mounting systems for optical sighting devices and, more specifically, to a mounting system permitting repeated attachment and detachment of an optical sighting device relative to a supporting base without interfering with the alignment of the device. The invention finds particular, but not exclusive, utility in a telescope mount for a rifle or other firearm.

In normal usage, optical sighting devices must be removed from their supports for purposes of cleaning, maintenance, transportation, storage, or protection. Upon completion of one or more of these functions, the sighting device must be reattached to its support, hopefully without interfering with the alignment of the device. With mounting systems of the type heretofore known, reattachment without disturbing the previous alignment of the sighting device would be extremely difficult and, in many instances, impossible.

SUMMARY OF THE INVENTION

One object of the present invention is to provide a mounting system for detachably securing an optical sighting device having a sighting axis to a supporting base having a base axis, wherein the sighting device is adapted to be repeatedly attached to and detached from the supporting base without interfering with the alignment between the two axes when the sighting device is attached to the base.

Another object is to provide a mounting system of the character set forth above utilizing five distinct, precisely spaced locating points between the sighting device and the supporting base to maintain precise alignment of the sighting axis with the base axis when the sighting device is attached to the supporting base, even after repeated detachment and reattachment cycles.

A further object is to provide a mounting system of the foregoing type which is particularly well adapted for use with the telescopic sight of a rifle or other firearm.

Another object is to provide a mounting system of the character set forth above which is highly preceise, relatively simple in construction, and adapted to permit attachment and removal of the optical sighting device without the need for tools or unusual dexterity.

Other objects and advantages of the invention will become apparent from the following detailed description, taken with the accompanying drawings.

Figure 1:
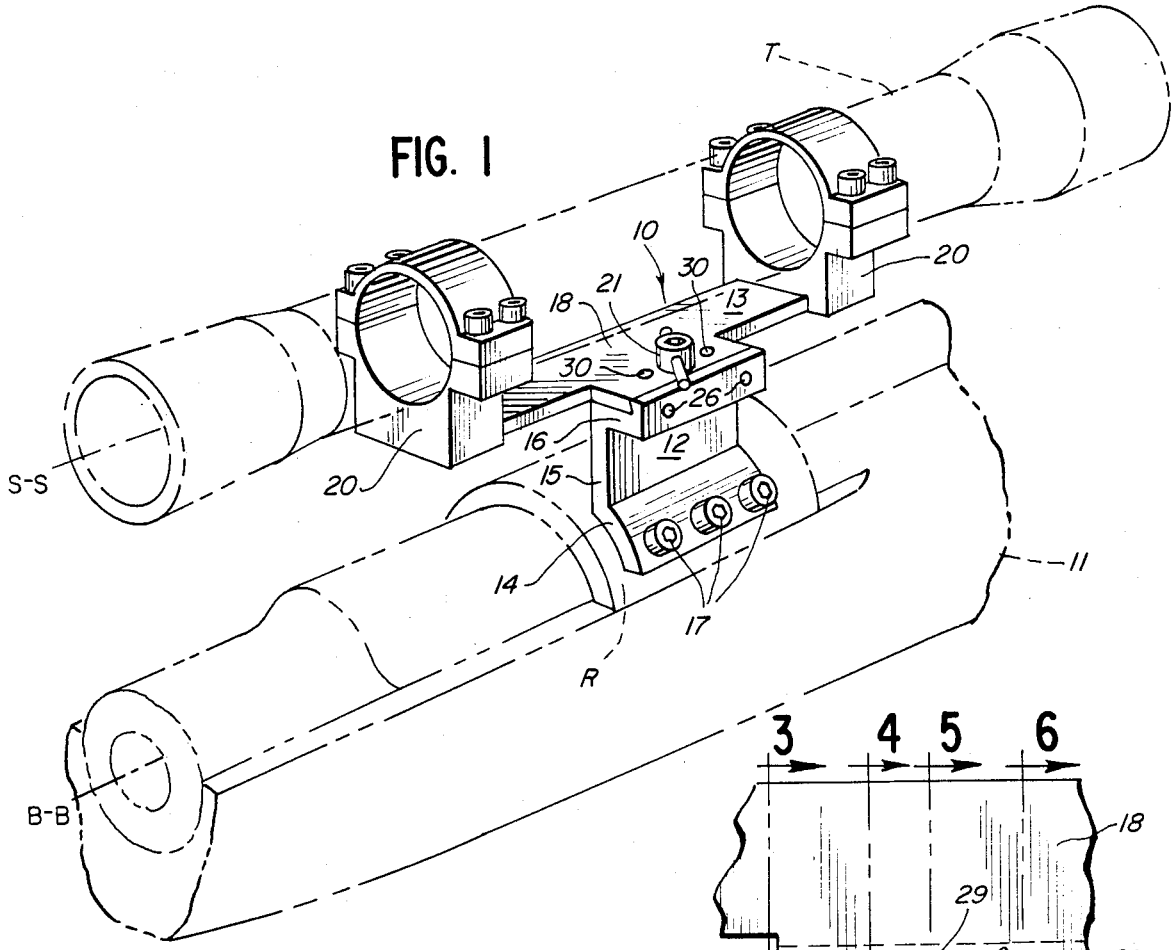
FIG. 1 is a perspective view showing an illustrative mounting system embodying the instant invention and which is utilized to secure a telescopic sight to a rifle.

While the invention is susceptible of various modifications and alternative constructions, an illustrative embodiment has been shown in the drawings and will be described below in detail. It should be understood, however, that there is no intention to limit the invention to the specific form described but, on the contrary, the intention is to cover all modifications, alternative constructions, and equivalents falling within the scope of the appended claims.

DETAILED DESCRIPTION

Referring more specifically to FIGS. 1–6, the invention is there exemplified in an illustrative mounting system 10 adapted in this instance to secure a telescopic sight T to the breech portion or receiver R of a rifle 11. The system 10 broadly comprises two members, a supporting base 12 fixed to the rifle receiver and a sighting device holder 13 detachably secured in precise position on the base 12. The components of the system 10 may be fabricated from appropriate materials such as steel or heat treated alumunium alloy.

A base axis B—B, in this instance the axis of the rifle barrel which is the guided device, is fixed relative to the base 12. A sighting axis S—S, in this case the axis of the telescopic sight T, is situated on the holder 13. With the holder secured to the base, the sighting axis S—S is initially aligned relative to the base axis B—B. The terms "aligned" or "alignment", as used herein, are intended to cover the relation between the axes S—S and B—B, ranging from parallelism to a relatively small acute angle required to compensate for the falling trajectory of the rifle shot.

As shown more particularly in FIG. 1, the base 12 is fashioned with an arcuate foot 14 adapted to nest against the receiver R. The foot 14 is integral with an upstanding leg portion 15 which terminates at its upper end in a mounting platform 16. The base 12 is secured to the receiver R as by means of cap screws 17 which clamp the foot 14 against the receiver R and engage tapped holes in the latter. The base 12 is mounted in a laterally offset position with respect to the rifle barrel so that the leg portion 15 will not block or preclude the use of the conventional open sights on the rifle.

The holder 13 comprises a mounting plate 18 of generally rectangular form with a laterally enlarged central portion 19 having the same longitudinal dimension as the base 12. The mounting plate 18 is provided at each end with a two-part clamping ring 20 for securing the telescopic sight T in place on the holder 18. In the present instance, the telescopic sight T is circular in cross section and the interior of each clamping ring 20 is configured to correspond to the size and shape of that portion of the sight T to be secured therein.

In accordance with the present invention, provision is made in the mounting system 10 for detachably securing the holder 13 and telescope sight T to the supporting base 12 so that proper alignment between the sighting axis S—S and the base axis B—B, once established, will be maintained despite repeated detachment and reattachment of the holder from the base. This is accomplished in the present instance by utilizing five distinct, precisely spacd locating points at the interface between the mounting platform 16 of the base and the mounting plate 18 of the holder. Cooperating with these locating points is a releasable clamp in the form of a clamp screw 21 and operating lever 22 adapted to secure the mounting plate in its precisely located position on the mounting platform 16.

Turning now to FIGS. 2–6, the locating and securing means of the mounting system 10 are shown in greater detail. The mounting platform 16 of the base 12 includes an undercut shoulder 24 which is approximately axially aligned with the barrel of the rifle 11. The mounting plate 21 of the holder includes a complemental engaging rib 25 which coacts with the shoulder 24 to define a first locating point for the holder 13 on the base 12. The shoulder 24 and rib 25 also cooperate to prevent movement of the holder 13 about a vertical axis. Further, because the shoulder 24 is undercut, when the holder 20 is located on the base 12, the shoulder will tend to prevent rocking movement of the holder on the base about the longitudinal and the transverse horizontal axes.

Figure 2A:
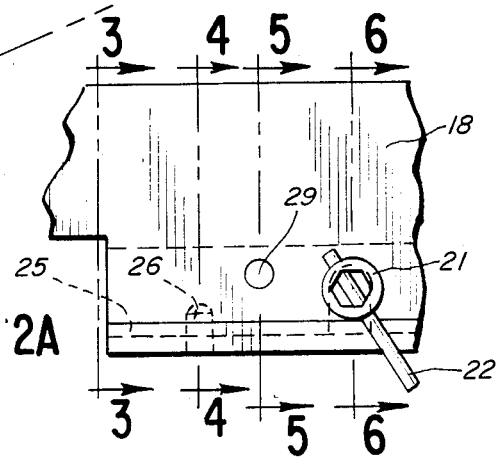
FIG. 2A is a fragmentary plan view of the mounting system of FIG. 1 in assembled condition.
Figure 2:
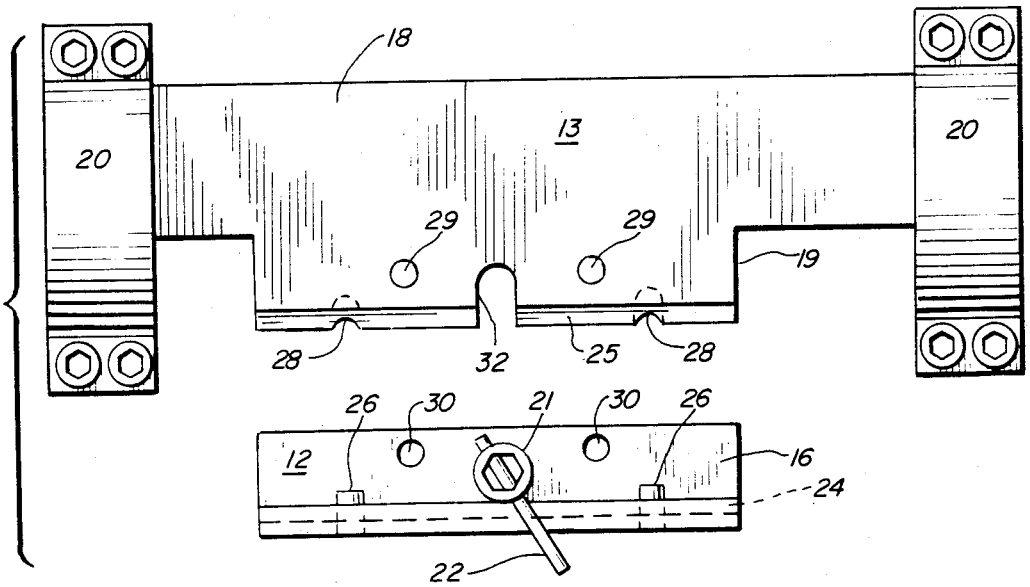
FIG. 2 is an exploded plan view of the major components of the mounting system of FIG. 1.
Figure 3:
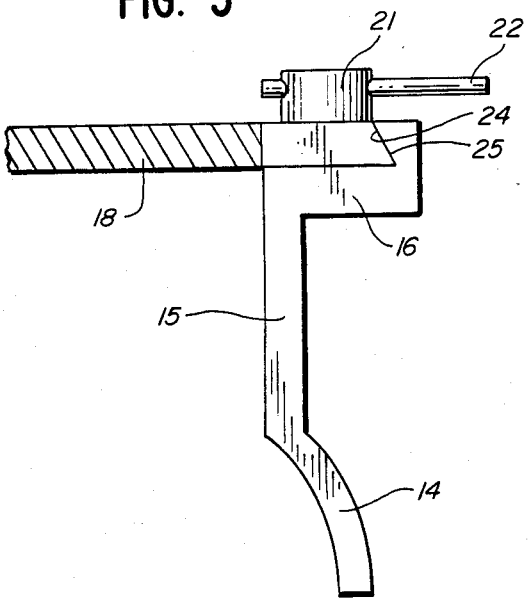
FIG. 3 is a vertical sectional view taken in the plane of line 3—3 in FIG. 2A.
Figure 4:
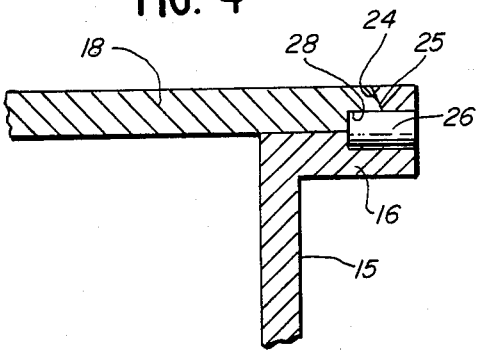
FIG. 4 is a vertical sectional view taken in the plane of line 4—4 in FIG. 2A.

As best shown in FIGS. 2, 2A and 4, two spaced apart parallel dowels 26 are situated on the mounting platform 16 of the base and disposed transversely of the undercut shoulder 24, projecting a substantial distance beyond the latter. The dowels 26 are generally parallel to the upper surface of the mounting platform 16 but recessed therein for half their cross sectional area. Each dowel 26 thus defines a half-cylindrical segment situated outwardly of the shoulder 24 and above the upper surface of the mounting platform 16. A complemental, closely fitting seat 28 for each of the dowels 26 is interposed in the rib 25 of holder mounting plate 18 and recessed into the underside of the latter. Each seat 28 is of semicircular cross section and adapted to fit closely with its corresponding dowel 26. The dowels 26 and their corresponding seats 28 thus define two additional precision locating points between the holder 13 and the base 12. When engaged, the dowels 26 and their cooperating seats 28 positively preclude longitudinal sliding movement of the holder 13 on the base 12.

Figure 5:
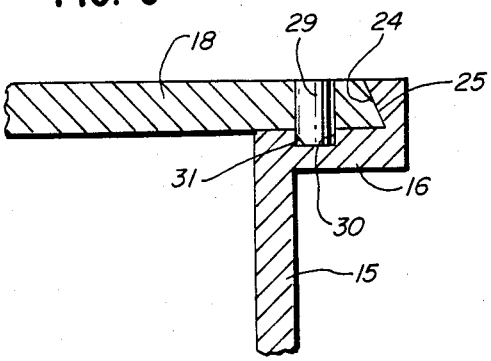
FIG. 5 is a vertical sectional view taken in the plane of line 5—5 in FIG. 2A.
Figure 6:
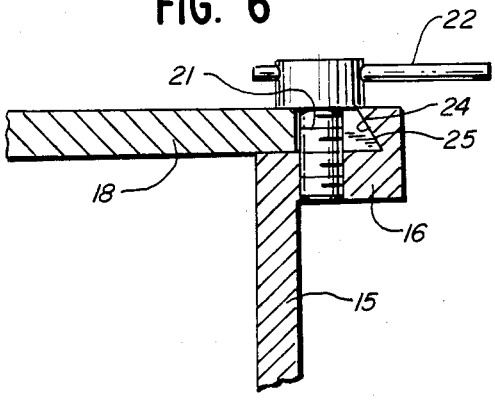
FIG. 6 is a vertical sectional view taken in the plane of line 6—6 in FIG. 2A.

Referring further to FIGS. 2, 2A and 5, the mounting plate 18 of the holder 13 is provided with two spaced apart parallel dowels 29 extending vertically below the underside of the mounting plate. The dowels 29 are disposed for precise engagement with corresponding complemental seats 30 recessed in the upper face of the mounting platform 16. The dowels 29 and their respective seats 30 cooperate to prevent sliding movement at the interface between the mounting plate of the holder 13 and the mounting platform 16 of the base in any direction. As detailed in FIG. 5, the edge of each dowel 29 remote from the undercut shoulder 24 has a bevel 31 with an angle corresponding approximately to that of the undercut shoulder 24. This facilitates entry of each dowel 29 into its associated seat 30 and removal therefrom.

As will be evident from the foregoing, there has been provided five distinct locating points for positioning the holder 13 with its telescopic sight T on the supporting base 12. These are: the undercut shoulder 24 and its complemental rib 25; the two dowels 26 on the undercut shoulder and their corresponding seats 28 in the engaging rib; and the two dowels 29 on the mounting plate with their corresponding seats 30 in the base. These five distinct, precisely spaced locating means cooperate to insure highly accurate positioning of the holder 13 with respect to the base 12 through numerous cycles of attachment and detachment.

To secure the holder 13 in its precise position on the base, releasable clamp screw 21 is utilized. In this case, clamp screw 21 is formed with a threaded shank which engages a tapped hole in the supporting platform of the base 12. The screw 21 has an enlarged head which is adapted to overlie and engage the marginal area of the mounting plate 18 surrounding a U-shaped clearance recess 32. The lever 22 connected with the clamp screw 21 permits the application of sufficient force to tighten and loosen the screw by fingertip forces without the need for tools.

To mount the holder 13 and telescopic sight T on the base 12, the holder is tilted with respect to the base and the rib 25 of the mounting plate 18 is brought into contact with the upper surface of the mounting platform 16. With the clamp screw 21 loose, the holder is then slid along the mounting platform until the rib 25 comes into contact with the undercut shoulder 24. With the seats 28, 30 lined up with their associated dowels 26, 29 and the clearance recess 32 straddling the clamp screw shank, the holder 13 is then brought to a horizontal position resulting in full engagement of the dowels 26 with their seats 28, the dowels 29 with their seats 30, and the rib 25 in full engagement with the undercut shoulder. Such full engagement of the dowels with their respective seats and the rib with the undercut shoulder occurs simultaneously. With the holder thus precisely positioned on the base 13, the clamp screw 21 is tightened down. The mounting system 10 and telescopic sight T are then ready for use. If not previously aligned, the telescopic sight T may then be adjusted to bring the sighting axis S—S into alignment with the base axis B—B of the rifle. Once such alignment has been established, the holder 13 with the telescopic sight may be repeatedly detached from and reattached to the base 12 without disturbing the alignment between the axes S—S and B—B.

While the invention has been shown and described with the undercut shoulder 24, dowels 26 and seats 30 being on the base 12, and with the rib 25, the seats 28, and dowels 29 being on the holder 13, it is apparent that the positions of some or all of these elements can be reversed without deviating from the present invention.

I claim as my invention:

1. A mounting system for repeatedly attaching and detaching an optical sighting device having a sighting axis to and from a guided device having a base axis while preserving precise alignment between said axes, said system comprising, in combination:

(a) a base member adapted for fixed attachment to said device;

(b) a mounting platform defined on said base member;

(c) a holder member including means for securing the optical sighting device thereto;

(d) means for detachably locating said holder member on said mounting platform of said base member, said means including first and second pairs of precisely spaced complemental locating elements, said first pair being oriented transversely of the base axis, said second pair being oriented in a different direction from said first pair such that each pair of said elements is adapted to enter into complemental engagement simultaneously to oppose relative movement between said base and holder members in any direction along the plane of said mounting platform; and (e) means for detachably clamping said holder member to said base mounting platform with said locating elements in complemental engagement.

2. A mounting system as defined in claim 1 wherein said locating means further comprises:

(a) a shoulder on one of said members and a rib complemental thereto on said other member;
(b) at least one dowel on one said member normal to the plane thereof and at least one seat complemental to said normal dowel on said other member; and
(c) at least one dowel on one said member parallel to the plane thereof and at least one seat complemental to said parallel dowel on said other member.

3. A mounting system as defined in claim 2 in which said shoulder is disposed on said base member in the direction of the base axis and said complemental engaging rib is situated on said holder member.

4. The mounting system of claim 1 wherein said locating means further comprises:
(a) an undercut shoulder disposed on said base member and a rib complemental to said shoulder, said rib being disposed on said holder member;
(b) a pair of spaced apart dowels on said holder member normal to the plane thereof and a corresponding pair of complemental seats in said base mounting platform normal to the plane thereof; and
(c) a pair of spaced apart dowels on said base member parallel to the plane of said mounting platform and a corresponding pair of complemental seats on said holder member parallel to the plane thereof.

5. The mounting system of claim 4 wherein said pair of dowels parallel to the plane of said mounting platform project transversely beyond said undercut shoulder and their complemental seats project transversely into said complemental rib.

6. The mounting system of claim 4 wherein the projecting portions of said pair of dowels parallel to the plane of said mounting platform are of semi-cylindrical shape.

7. The mounting system of claim 1 wherein said locating means further comprises:
(a) an undercut on said base member and a complementary rib on said holder member;
(b) a first pair of spaced apart dowels on said base member and a corresponding pair of seats complemental thereto on said holder member;
(c) a second pair of spaced apart dowels on said holder member and a corresponding pair of seats complemental thereto on said base member; and
(d) said shoulder and rib and said respective dowels and their complemental seats defining five distinct and precisely spaced points for positioning said holder member on said base member with a high degree of accuracy.

* * * * *